US012193632B2

(12) United States Patent
Hellwig et al.

(10) Patent No.: US 12,193,632 B2
(45) Date of Patent: Jan. 14, 2025

(54) FLOOR CLEANING DEVICE WITH FLOOR DETECTION AND METHOD

(71) Applicant: VORWERK & CO. INTERHOLDING GMBH, Wuppertal (DE)

(72) Inventors: Richard Hellwig, Nordkirchen (DE); Johannes Jung, Ennepetal (DE); Jens Greving, Wuppertal (DE); Viktor Bezsonov, Düsseldorf (DE)

(73) Assignee: VORWERK & CO. INTERHOLDING GMBH (DE)

( * ) Notice: Subject to any disclaimer, the term of this patent is extended or adjusted under 35 U.S.C. 154(b) by 191 days.

(21) Appl. No.: 17/885,028

(22) Filed: Aug. 10, 2022

(65) Prior Publication Data

US 2023/0075865 A1 Mar. 9, 2023

(30) Foreign Application Priority Data

Sep. 9, 2021 (EP) ..... 21195692

(51) Int. Cl.
*A47L 9/28* (2006.01)
*A47L 9/04* (2006.01)

(52) U.S. Cl.
CPC ..... *A47L 9/2826* (2013.01); *A47L 9/0411* (2013.01); *A47L 9/0477* (2013.01); *A47L 9/2831* (2013.01); *A47L 9/2847* (2013.01)

(58) Field of Classification Search
CPC ..... A47L 11/19; A47L 9/0477; A47L 9/2831; A47L 9/2842; A47L 11/185; A47L 11/4011
See application file for complete search history.

(56) References Cited

FOREIGN PATENT DOCUMENTS

| | | | |
|---|---|---|---|
| DE | 102007021299 | A1 | 11/2008 |
| EP | 0527567 | A2 | 2/1993 |
| EP | 2457486 | A2 | 5/2012 |
| EP | 3000374 | A2 | 3/2016 |

OTHER PUBLICATIONS

Search Report for Application No. 21195692.5, dated Mar. 22, 2022 (2 pages).

*Primary Examiner* — David Redding
(74) *Attorney, Agent, or Firm* — Barnes & Thornburg LLP

(57) ABSTRACT

An apparatus for cleaning a floor surface including a control unit, a cleaning member for picking up dirt from the floor surface by moving the cleaning member, and an electric motor for moving the cleaning member. The electric motor is such that relative movement between a stator and a rotor of the electric motor can lead to an induction of a voltage and a reverse current. The control unit is configured such that a power supply of the electric motor is temporarily interrupted during a cleaning operation of the floor surface, and the control unit identifies a present surface condition of the floor surface currently being cleaned by means of the cleaning member on the basis of a detected current curve of the electric motor.

14 Claims, 2 Drawing Sheets

FLOOR CLEANING DEVICE WITH FLOOR DETECTION AND METHOD

CROSS-REFERENCE TO RELATED APPLICATION

This application claims benefit of priority to European Application No. 21195692.5, filed on Sep. 9, 2021, the disclosure of which is hereby incorporated in its entirety by reference herein.

TECHNICAL FIELD

The present disclosure generally relates to an apparatus and a method for cleaning a floor surface.

BACKGROUND

There are floor cleaning devices that are equipped with complex systems for determining the floor condition and floor detection. Examples of these are described in the publications DE102007021299A1 and EP3000374A1.

SUMMARY

It is the task of the present disclosure to provide a further developed, in particular simpler solution for determining the floor condition and floor detection.

An apparatus for cleaning a floor surface according to the main claim and a method according to the additional claim serve to solve the task.

An apparatus for cleaning a floor surface comprising a control unit, a cleaning member, in particular a cleaning roller, for picking up dirt from the floor surface by moving the cleaning member, in particular rotating the cleaning roller, and an electric motor for moving the cleaning member, in particular for rotating the cleaning roller, serves to solve the task. The electric motor is such that a relative movement between a stator and a rotor of the electric motor can lead to an induction of a voltage and a reverse current that can be detected in particular by the control unit. The control unit is configured such that a power supply of the electric motor is temporarily interrupted during a cleaning operation of the floor surface, and the control unit identifies a present surface condition of the floor surface, which is currently (at the current moment) being cleaned by means of the cleaning member, in particular by means of the cleaning roller, on the basis of a detected current curve of the electric motor, the detected reverse current and/or a detected current drop, in particular during and/or immediately following the interruption of the power supply.

In this way, an analysis for identifying a surface condition can be enabled in a particularly simple manner, without additional sensors and with low computing capacity. For example, it is particularly easy to determine whether the apparatus during operation is currently engaged with a hard floor surface or a carpet floor surface or whether a hard floor surface or a carpet floor surface is currently being cleaned. Surface conditions include, in particular, carpet floor surface, hard floor surface and/or different types of floor surfaces, which have different properties with regard to interaction with the cleaning member, e.g. due to certain surface structures, materials or coatings.

BRIEF DESCRIPTION OF THE DRAWINGS

The figures show:

FIG. 1 shows a schematic representation of an apparatus 1 for cleaning a floor surface 10. The floor surface 10 has a first region with the surface condition of a hard floor surface 11 and an adjacent, second region with the surface condition of a carpet floor surface 12.

DETAILED DESCRIPTION

Figure 1:
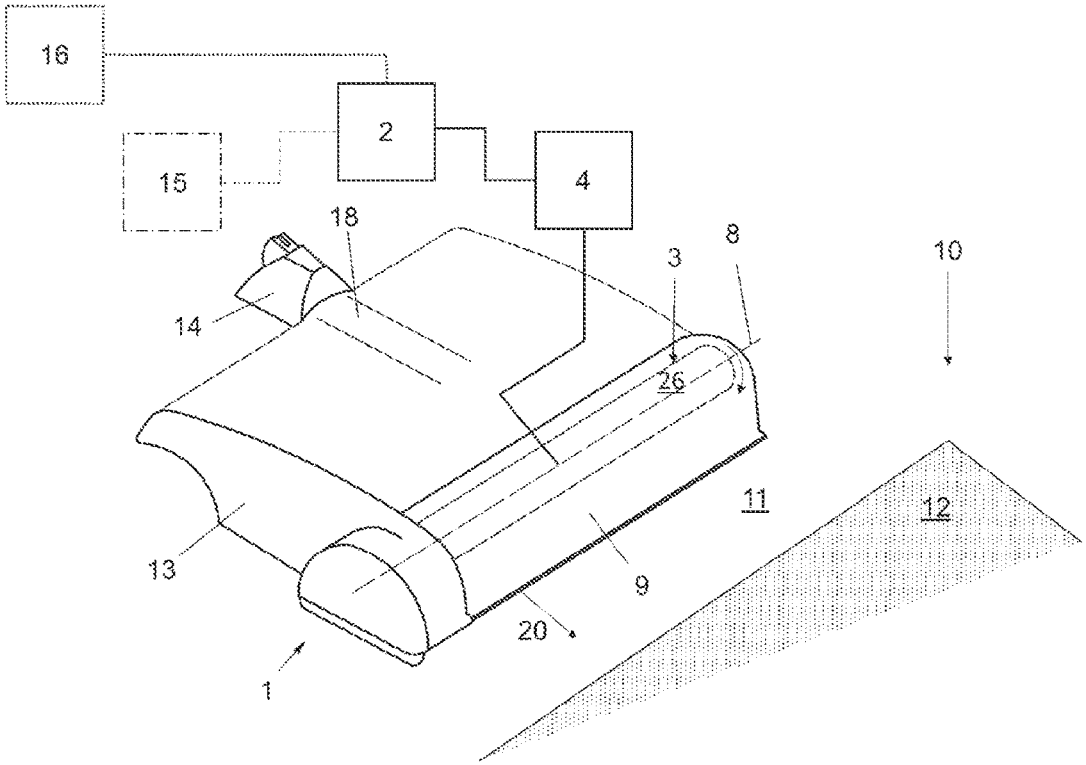
FIG. 1: Schematic representation of an apparatus for cleaning a floor surface.

The apparatus of FIG. 1 is a vacuum cleaner, which represents the preferred embodiment, and moves for cleaning in feed direction 20. The feed direction 12 is oriented in particular perpendicular to the roller axis 8. The apparatus 1 has a housing 9 and a cleaning roller 26 as the cleaning member 3, which in operation rotates about the roller axis 8 in the direction indicated by the arrow. The cleaning roller 26 is arranged in a cylinder-like tunnel of the housing 9 and is in contact with the floor surface 10. The outlines of the apparatus illustrated in FIG. 1 show an attachment device 13, which either corresponds to the apparatus 1 or is part of the apparatus 1.

A control unit 2 of the apparatus 1, which is integrated in the attachment device and/or in the base apparatus, controls the power supply of the electric motor 4. For this purpose, the control unit 2 has access to information about the current and voltage applied to the electric motor.

For cleaning the floor surface 10, the rotating cleaning roller 26 conveys dirt from the floor surface 10 in the direction of a suction opening, which is concealed in FIG. 1 and is present at the end of a suction channel 18 of the attachment device 13. The suction channel 18 is connected via a connection 14 to a base apparatus, which is not shown and comprises a blower 15 for sucking in air. The attachment device 13 and/or the base apparatus comprise a user interface 16. In particular, the user interface 16 can be used to select between an automatic operation and a manual operation. If the apparatus 1 is a vacuum cleaner, the apparatus comprises both the blower 16 and the attachment device 13 or components thereof.

Figure 2A:
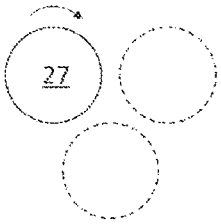
FIG. 2A-2C: Schematic representation of alternative cleaning members from below.
Figure 2B:
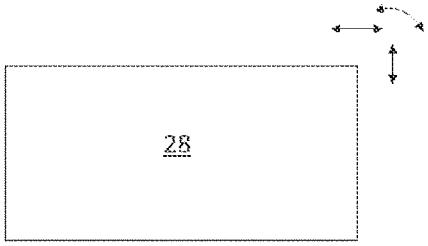
Figure 2C:
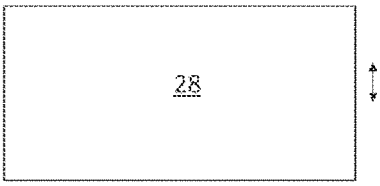

FIGS. 2A to 2C show different cleaning members 3 that can be used instead of the cleaning roller 26 analogous to the exemplary embodiment of FIG. 1. FIG. 2A shows a polishing disc 27 as cleaning member 3. If the apparatus is a suction polisher, the apparatus comprises at least the polishing disc 27. An axis of rotation of the polishing disc 27, which is not shown, is then perpendicular to the underside of the attachment device and/or the floor surface. In particular, the polishing disc 27 has a ring of bristles protruding downward on the underside in the edge region. During cleaning, only the bristles then come into contact with the floor surface 10 to be cleaned. Preferably, a suction polisher as the apparatus has several polishing discs 27. In FIG. 2A, several polishing discs 27 are shown by way of example with a dashed line. Preferably, exactly three polishing discs 27 are then provided, which are arranged in particular in a triangular manner. In a triangular arrangement, the axes of rotation of the polishing discs 27 form a triangular shape, in particular with two or three legs of equal length. FIGS. 2B and 2C show a wiping plate 28 configured to hold a replaceable cloth or sponge. When the apparatus is a suction wiper, the apparatus comprises the wiping plate 28. In operation, the wiping plate 28 moves with the cloth or sponge relative to the housing of the apparatus substantially parallel to the underside of the attachment device and/or parallel to the floor surface. FIG. 2B illustrates the oscillating motion of the wiping plate 28, which is preferably a combination of rotation and translation. In particular, this combination motion is generated by one or more off-center drive shafts, not shown in FIG. 2B. If several off-center drive shafts are provided, they are driven by the same motor and are coupled to the wiping plate 28 at different locations. FIG. 2C illustrates the oscillating motion of the wiping plate 28, which is preferably translational. A transmission (gearbox), which is not shown, provides here for a conversion of the drive rotation of the electric motor into a translatory movement of the wiping plate 28.

Figure 3:
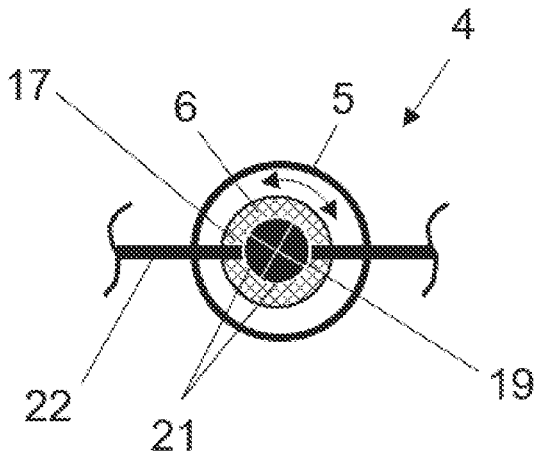
FIG. 3: Schematic representation of an electric motor.

FIG. 3 shows a schematic representation of an electric motor 4 which can be used, for example, in the apparatus 1 of FIG. 1. A stator 5, fixedly connected to a housing not shown, surrounds an internal, rotatable rotor 6. A disc-shaped commutator 19, rotating together with the rotor 6, has a plurality of terminals 21 in the form of ring-segment-like sections, each electrically connected to a coil not shown. A brush 17 is used to electrically connect an electric circuit 22 to the moving terminals of the disc-shaped commutator 19 so that the rotor 6 rotates as smoothly as possible relative to the stator 5. The rotor 6 is rotationally coupled to a cleaning member 3, preferably to the cleaning roller 26 of FIG. 1.

Figure 4:
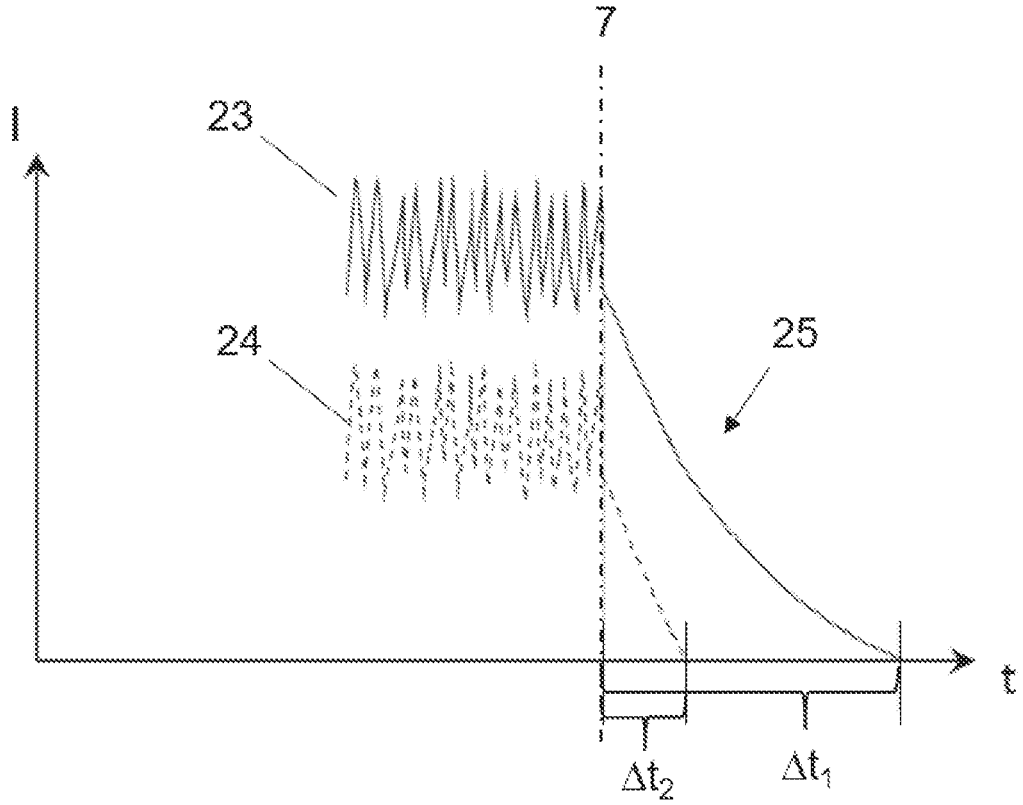
FIG. 4: Schematic representation of a current curve over time.

FIG. 4 shows a diagram of a current I over a time t. In particular, this is the current curve applied to the electric motor 4 of FIG. 1 and/or 3. The diagram shows a first current curve 23 (shown with a solid line) and a second current curve 24 (shown with a dashed line), each of which shows a curve of a current before interruption 7 of the power supply to the electric motor. Before the interruption 7, the current of the power supply is adjusted by the control unit in particular in such a way that a target speed of the cleaning member 3 is achieved. If a gear unit with a transmission ratio not equal to 1 is used, a target speed of the rotor differs from the target speed of the cleaning member 3.

The supplied current of the first current path 23 is provided in particular for cleaning a carpet floor and is on average higher than the supplied current of the second current path 24, which is provided in particular for cleaning a hard floor.

After the interruption 7 of the power supply, the current curve 25 shows that the current drops, which is referred to as current drop in this document. A reverse current is generated by the induction of a voltage after the interruption 7 of the power supply. The time period Δt from interruption 7 until the current reaches or falls below a predefined, reduced value, here zero amperes, is measured. In the exemplary embodiment of FIG. 4, the current required the time period $\Delta t_1$ to drop from the level of the first current flow 23 for cleaning a carpet floor after interruption 7 of the power supply to zero amperes. Similarly, the current required the time period $\Delta t_2$ to drop to zero amperes from the level of the second current flow 24 for cleaning a hard floor after interruption 7 of the power supply, which is also referred to as zero crossing. The lower the load, that is, the current, the faster the zero crossing occurs. In particular, the speed is kept constant by a speed control.

Thus, the load (current) is detected and the time period Δt of the load drop down to a predetermined value (here e.g. 0 A) is measured. After determining the time period Δt, here $\Delta t_1$ or $\Delta t_2$, the determined time period Δt is compared with a threshold value for a cleaning mode or value ranges for several cleaning modes (not shown in FIG. 4).

In one embodiment, the automatic operation is configured such that one of a plurality of cleaning modes which is assigned to the identified present surface condition 11, 12 is activated depending on the identified present surface condition 11, 12. This configuration is explained below with reference to an exemplary example comprising a carpet cleaning mode and a hard floor cleaning mode. The apparatus is here exemplarily a vacuum cleaner, a vacuum cleaner attachment device or a suction robot, wherein at the beginning of the example the apparatus 1 cleans a floor surface 10 in the hard floor cleaning mode (with a target speed of the cleaning roller of e.g. 1500 rpm; in particular an increased suction power) and the cleaning roller 26 rests on a surface condition of the type hard floor surface 11. The sequence in automatic operation according to this configuration is as follows:

In particular, the power supply is first interrupted, the time period Δt is determined, the interruption 7 of the power supply is removed so that the electric motor 4 is supplied with power again, and the determined time period Δt is compared with at least one threshold value (here: a hard floor threshold value, in particular also a carpet threshold value).

If the comparison shows that the time period Δt (e.g. $\Delta t=\Delta t_1$) has fallen below the hard floor threshold, i.e. $\Delta t_2$<hard floor threshold, the surface condition of type hard floor surface 11 assigned to this value range is identified as the present surface condition. If the identified, present surface condition is assigned to the current cleaning mode (according to an assignment stored in the control unit 2), cleaning is continued unchanged in the current cleaning mode (in this example: hard floor cleaning mode).

If the comparison shows that the time period Δt (e.g. $\Delta t=\Delta t_1$) has exceeded the hard floor threshold or alternatively a carpet threshold, i.e. $\Delta t_1$>hard floor threshold (or alternatively: $\Delta t_1$>carpet threshold), the surface condition of type carpet floor surface 12 assigned to this value range is identified as the present surface condition. If the identified present surface condition (according to an assignment stored in the control unit 2) is not assigned to the current cleaning mode (as in this example), the cleaning mode is changed (in this example: from the hard floor cleaning mode to the carpet cleaning mode) and the cleaning is continued in the new cleaning mode (carpet cleaning mode: target speed of the cleaning roller of e.g. 4500 rpm; in particular a reduced suction power). The cleaning roller 26 now rests on a floor surface 10 with the floor condition of the type carpet floor surface 12. In one preferred configuration, for a change of the cleaning mode the additional criterion is provided that the threshold value for time x is fallen below or exceeded, with x e.g. 200 ms-800 ms.

In particular, again, the power supply is interrupted, the time period Δt is determined, the interruption 7 of the power supply is removed so that the electric motor 4 is supplied with power again, and the determined time period Δt is compared with at least one threshold value (here: a carpet threshold value, in particular also a hard floor threshold value).

If the identified present surface condition is assigned to the current cleaning mode (in this example e.g. $\Delta t=\Delta t_1$), the cleaning mode is continued, otherwise (in this example e.g. $\Delta t=\Delta t_2$) it is changed accordingly (analogously as explained above).

So, in this example, if the carpet threshold is exceeded, cleaning continues unchanged, and if the carpet threshold is undercut, there is a change from carpet cleaning mode to hard floor cleaning mode.

Measuring the back EMF (current) and measuring the current drop over time allows easy detection of the floor covering with little effort. In particular, a measurement of the BEMF voltage to determine when the current has reached zero crossing further reduces the effort. The measured time is compared with stored threshold values, which are then used to decide which substrate the cleaning roller is located.

In particular, the measurement of the back EMF is performed in a measurement interval of about 100 μs to 200 μs for the regular de-energizing of the electric drive with the electric motor 4. By measuring the current curve of the electric motor, no additional sensor is required for floor detection. Likewise, no high-precision measurement of e.g. current or voltage is necessary to analyze and detect complex characteristics, but only a threshold value monitoring of the time period Δt. An automatic operation can thus be implemented without additional sensors and with low computational effort.

The system and method of the present disclosure is based on the insight that an evaluation of the detected current curve after an interruption of the power supply of the electric motor allows a conclusion about the surface condition of the floor surface in a particularly simple manner and without additional sensors. Usually, the power supply of the electric motor is not interrupted during a cleaning operation, because the user would typically consider the outage of the drive of the cleaning member as a malfunction or defect. However, it has been recognized that the above-mentioned evaluation on the basis of the detected current curve can be performed after the interruption of the power supply of the electric motor within a period of time which, despite the performed interruption of the power supply of the electric motor, does not cause a user to consciously perceive this interruption or at least does not consider it to be a malfunction or defect.

In particular, the control unit is configured such that the electric motor is supplied with electric current for rotating the cleaning member at a target speed. The speed of the electric motor and thus the speed of the cleaning member is kept approximately constant by means of a speed control. In particular, the electric motor is a DC motor, preferably with brush. Various embodiments of the electric motor and its structure are also described in more detail below. The current curve detected by the control unit starts after the power supply to the electric motor is interrupted. The current curve of the electric motor after the interruption of the power supply is a curve of a current over time. The current curve of the electric motor after the power supply interruption is a load curve of the electric motor detected by the control unit. The current of the current curve is the current applied to the electric motor after the power supply interruption. An electric motor power supply circuit has the current curve of the electric motor after the electric motor power supply is interrupted.

Picking up dirt from the floor surface by the motor-driven cleaning member, in particular a rotating cleaning roller, is preferably performed by moving dirt on the floor surface through the cleaning member towards a suction opening of the apparatus. The dirt is then sucked in by the suction opening. Some embodiments of the apparatus and their construction are explained in more detail below.

In one embodiment, the control unit is configured such that for detection of the present surface condition it is detected when the current curve, the reverse current or the detected, dropping current reaches or falls below a predefined, reduced value after the power supply is interrupted. A particularly simple analysis for the identification of a surface condition can be enabled in this way. This embodiment takes advantage of the fact that when cleaning, for example, a carpet (or a type of floor surface that has a surface condition with a high frictional resistance) with comparatively high mechanical resistance for the cleaning member, the electric motor is supplied with a relatively high current during operation. After the interruption of the power supply, depending on the surface condition, a difference can be determined when a predefined, reduced value is reached or undercut by the current curve, the reverse current or the detected, dropping current after the interruption of the power supply. Preferably, the time of reaching or falling below the predefined, reduced value is detected.

In one embodiment, the predefined, reduced value is zero amperes. A particularly simple analysis for identifying a surface condition can thus be made possible. The value of zero amperes can be detected particularly easily.

In a preferred configuration, the induced voltage is measured. The effect of back EMF (electromotive force) causes the induced voltage after the interruption of the power supply to the electric motor. The time of reaching or falling below zero amperes by the current curve, the reverse current or the detected, dropping current after the interruption of the power supply can be determined in this way particularly simply on the basis of the measurement of the induced voltage and the computational effort can be further reduced.

In one embodiment, the predefined reduced value is an ampere value that is lower than 0.5 A and/or greater than zero amperes. The identification of the present surface condition can thus be accelerated and problems due to measurement inaccuracies can be prevented.

In one embodiment, the control unit is configured such that, for determining the surface condition of the floor surface, a time period from the interruption of the power supply until the current curve, the return current or the detected current after the interruption of the power supply reaches or falls below the predefined, reduced value is measured. The measurement of a time period can be implemented with little computational effort, so that a simple system for the analysis is already sufficient for the identification of a surface condition.

In one embodiment, the control unit is configured such that the control unit, in order to identify the present surface condition, checks whether the determined time period falls below or exceeds a threshold value. In this way, a predefined surface condition can be assigned particularly easily on the basis of the determined time period and identified as the present surface condition.

In one embodiment, a time period that falls below a hard floor threshold or is below the hard floor threshold is assigned the surface condition named hard floor.

In the present disclosure, a hard floor threshold may be replaced by a threshold for a predefined, first surface condition and a carpet threshold may be replaced by a threshold for a predefined and different second surface condition.

In one embodiment, a time period that exceeds or is above a carpet threshold (or the hard floor threshold) is assigned the surface condition named carpet floor.

In one embodiment, the control unit is configured such that the control unit, in order to identify the present surface condition, checks whether the determined time period falls into one of several predefined value ranges, each of which is assigned a predefined surface condition. In a particularly simple implementation, a first value range is defined (only) by a lower limit in the form of the threshold value and/or a second value range is defined (only) by an upper limit in the form of the threshold value. In a further development, there are only two value ranges. This enables a particularly simple system.

In an alternative embodiment, more than two value ranges are provided, wherein at least one of the value ranges has a lower limit and an upper limit. In particular, a different predefined surface condition is assigned to each value range. In an alternative configuration, the same surface condition is assigned to multiple value ranges.

When a range of values is identified in which the determined time period falls, the surface condition assigned to the identified range of values is identified as the present surface condition.

In one embodiment, a hard floor surface and a carpet floor surface are two predefined surface conditions that are stored, i.e., saved, in the control unit. A hard floor surface as a predefined surface condition has the property of a smooth surface structure. Typically, the mechanical resistance or frictional resistance for a rotating cleaning roller is relatively low. A carpet floor surface as a predefined surface condition has the property of a surface made of fibers. Typically, the mechanical resistance or frictional resistance for a rotating cleaning roller is relatively high. The provision of the predefined surface conditions hard floor surface and carpet floor surface has the advantage that this assignment can be enabled particularly simply and reliably on the basis of the current curve, the return current or the current drop after the interruption of the power supply and already this identification of these two surface conditions enables further developments such as an automatic operation, which is described in more detail below.

In one embodiment or according to a further, independent aspect of the present disclosure, the control unit is configured such that the control unit identifies a degree of contamination of the floor surface and/or a degree of wear of the cleaning member, in particular a degree of wear of the cleaning roller, on the basis of the detected current curve, the reverse current and/or a detected current drop immediately following the interruption of the power supply. An analysis not only for the identification of a surface condition, but also for the identification of a degree of contamination of the floor surface and/or a degree of wear of the cleaning member, in particular a degree of wear of the cleaning roller, can be enabled in this way particularly simply, without additional sensors and with low computing capacity. In particular, predefined value ranges for certain degrees of contamination, e.g. heavily soiled, slightly soiled or not soiled at all, and/or predefined value ranges for certain degrees of wear, e.g. heavily worn, slightly worn or not worn at all, are stored in the control unit. Alternatively or additionally, it can be provided to determine within a predefined value range a degree of contamination of the floor surface and/or a degree of wear of the cleaning member, in particular a degree of wear of the cleaning roller, by a correlation with the determined time period or the current curve. In the case of an independent aspect of the present disclosure, it is not necessary to identify the present surface condition when identifying the degree of contamination and/or a degree of wear. Rather, it may be a separate or additional system for identifying the degree of contamination and/or a degree of wear, which also analogously to the identification of the present surface condition during a cleaning operation of a floor surface temporarily interrupts a power supply of an electric motor by the control unit, and the control unit on the basis of the detected current curve, the reverse current and/or a detected current drop immediately following the interruption of the power supply identifies a present surface condition of the floor surface, which is currently cleaned by means of a cleaning member, in particular by means of a cleaning roller. This separate aspect of the present disclosure then also relates to an apparatus for cleaning a floor surface comprising the control unit, the cleaning roller for picking up dirt from the floor surface by moving the cleaning member, in particular rotating the cleaning roller, and the electric motor for moving the cleaning member, in particular for rotating the cleaning roller, wherein the electric motor is such that a relative movement between a stator and a rotor of the electric motor can lead to an induction of a voltage and a current curve, reverse current or current drop detectable by the control unit after the interruption of the power supply. The definitions, embodiments, and effects of the aspect of the present disclosure described at the outset and explained previously and below are also applicable to this aspect of the present disclosure.

In one embodiment, the cleaning member is a cleaning roller. Alternatively, the cleaning member is a polishing disc or a wiping plate.

In one embodiment, the control unit comprises at least two cleaning modes, each of which specifies a different target speed for the cleaning member, in particular a cleaning roller. Preferably, the cleaning modes are adapted to a surface condition of a floor surface to be cleaned. In particular, each cleaning mode of the cleaning modes defines not only a target speed for the cleaning member, but also a target suction power for a blower. In particular, the target suction powers of the cleaning modes are different in each case. In case the apparatus is a vacuum cleaner, suction polisher, suction wiper or suction robot, the blower is comprised by the apparatus. In case the apparatus is an attachment device, the target suction power is transmitted to a base apparatus with a blower. In particular, there are exactly two cleaning modes with stored, different target speeds to make the system particularly simple. Two cleaning modes are already sufficient to obtain a significantly improved cleaning result of e.g. hard floors and carpet floors.

In one embodiment, the cleaning modes consist of or comprise a carpet cleaning mode and a hard floor cleaning mode. A significantly improved cleaning result can be achieved in this manner with a particularly simple system. In the present disclosure, the carpet cleaning mode may be replaced by a predefined, first cleaning mode and the hard floor cleaning mode may be replaced by a predefined, second cleaning mode.

In one embodiment, a target speed of the cleaning member in the carpet cleaning mode or first cleaning mode is greater than in the hard floor cleaning mode or second cleaning mode. Alternatively or additionally, a target suction power of a blower in the carpet cleaning mode or first cleaning mode is smaller than in the hard floor cleaning mode or second cleaning mode. A significantly improved cleaning result can be achieved in this manner with a particularly simple system.

In one embodiment, the target rotational speed of the cleaning roller in the hard floor cleaning mode is at least twice and/or at most four times, particularly preferably about three times as great as in the carpet cleaning mode. Preferably, the target speed of the cleaning roller in the hard floor cleaning mode is between 1000 and 2000 rpm, preferably about 1500 rpm, and/or in the carpet cleaning mode is between 4000 and 5000 rpm, preferably about 4500 rpm. These speed ranges are possibly common speed ranges for floor cleaning. However, what is particular about these speed ranges, ratios and approximate speeds is that they universally achieve very good cleaning results in combination with easy identification of the present surface condition according to the present disclosure, particularly using only one threshold and the only two predefined surface conditions hard floor surface and carpet floor surface. In the exemplary embodiment, this will be discussed in more detail.

In one embodiment, the control unit is configured such that, when a change in the present surface condition is identified, it is switched between the cleaning modes. This enables the implementation of an automatic operation, which in one embodiment activates, on the basis of the identified, present surface condition, a corresponding cleaning mode, which has been assigned to the identified surface condition in the control unit. In a further development, a user can select and/or switch between a manual operation and an automatic operation, in particular via a user interface.

A change of the present surface condition means that a floor surface has a first region with a first surface condition and adjacent to it a second region with a second surface condition. The change occurs when the cleaning member of the apparatus gets from the first region to the second region and comes into contact with the second surface condition, i.e. the new surface condition.

In one embodiment, the control unit is configured such that the change of the cleaning mode occurs only if a new surface condition is identified in an unchanged manner for a predefined period of time. A particularly high reliability of a still simply constructed system can be realized in this way. The identification of the present surface condition is not only performed once at the beginning of the cleaning operation, but several times during a cleaning operation. If at least two consecutive results of the identification of the present surface condition result in the same surface condition and these two results are within the predefined period of time, the criterion of this embodiment is fulfilled and the change of the cleaning mode can take place.

In one embodiment the predefined period is at least 200 ms and/or at most 800 ms. A particularly high reliability of a still simply constructed system can be realized in this way.

In one embodiment, the control unit is configured such that the power supply to the electric motor is interrupted at a regular interval and/or the present surface condition of the floor surface is identified on the basis of the detected current curve, the return current and/or a detected current drop immediately following the interruption of the power supply. A particularly high reliability with regard to the identification of the present surface condition can be realized in this way with a still very simply constructed system. Furthermore, a regular interval has the advantage that the user does not interpret the interruptions of the power supply to the electric motor as an error, provided that the user perceives the interruption.

In one embodiment, the interval is at least 100 μs and/or at most 200 μs. The advantage described above can be achieved particularly effectively in this way.

Another aspect of the present disclosure relates to a method for identifying a surface condition, with the steps of:

interrupting a power supply of an electric motor moving, in particular rotating, a cleaning member, in particular a cleaning roller, for cleaning a floor surface having the surface condition during a cleaning operation of the floor surface;

detecting a current curve of the electric motor after the interruption of the power supply and/or a reverse current or a current drop during an induction of a voltage due to a relative movement between a stator and a rotor of the electric motor after the interruption of the power supply;

identifying the present surface condition of the floor surface currently being cleaned by means of the cleaning member, in particular by means of the cleaning roller, on the basis of the detected current curve, reverse current and/or current drop.

In this way, an analysis for identifying a surface condition can be performed particularly easily, without additional sensors and with low computing capacity. In particular, it can be determined particularly easy whether a hard floor surface or a carpet floor surface is currently being cleaned, or whether a change has taken place between two regions of the floor surface with different surface conditions. The definitions, embodiments and effects of the aspect of the invention described at the beginning are also applicable to this aspect of the invention.

Preferably, the control unit comprises a processor and a memory with computer program code, i.e., instructions storable on the memory. The processor, the memory, and the computer program code are configured such that a method comprising a plurality of method steps can be performed.

A further aspect of the present disclosure relates to a computer program product comprising instructions which, when the program of the computer program product is executed by a computer, in particular a control unit, cause the computer to perform the steps of the method according to the preceding aspect of the present disclosure. By method steps, for example, a determining can be realized. Preferably, a determining is carried out on the basis of an input variable by a predefined algorithm or predefined method steps, which can in particular be mapped in a computer program code.

The apparatus for cleaning a floor surface is preferably a vacuum cleaner, i.e. a floor vacuum cleaner with a handle for movement by a user, or a suction robot. In one embodiment, the apparatus is an attachment device for a base apparatus, wherein the base apparatus together with the attachment device forms a functional floor vacuum cleaner, vacuum polisher, or vacuum wiper. If the apparatus is a floor vacuum cleaner, the apparatus or an attachment device of the apparatus comprises a cleaning roller. If the apparatus is a suction polisher, the apparatus or an attachment device of the apparatus comprises at least one polishing disc. If the apparatus is a suction wiper, the apparatus or an attachment device of the apparatus comprises at least one wiping plate. In particular, a data interface may be provided between the attachment device and the base apparatus to communicate information or commands based on the identified present surface condition to the base apparatus, for example, to adjust a suction power of a blower.

The apparatus preferably comprises an operator interface that allows the user to set different operation modes. In one embodiment, the operator interface allows to turn on and off the apparatus. In one embodiment, the operator interface allows to switch between a manual operation and an automatic operation.

An attachment device is in particular a separate functional component (e.g. of a vacuum cleaner, suction polisher or suction wiper) that can typically be connected to a base apparatus, in particular a vacuum cleaner, suction polisher or suction wiper, via a mechanical and/or electrical connection. A suction opening of the attachment device is fluid-tightly connected to a suction line of the base apparatus, in particular by means of the connector. Fluid-tight means that, for example, air can be sucked in by a blower located in the base apparatus with sufficiently low power loss via the suction opening of the attachment device so that a floor surface can be cleaned. In particular, the electric motor for driving the cleaning member is arranged in the attachment device. In particular, the same base apparatus can form a vacuum cleaner, suction polisher or suction wiper depending on the type of attachment device. An attachment device for a vacuum cleaner includes a cleaning roller as a cleaning member. An attachment device for a suction polisher includes a polishing disc as cleaning member. In particular, the cleaning member, which is preferably round or disc-shaped, is then rotated about its axis of rotation for cleaning a floor surface, so that bristles on the underside of the polishing disc which are for example arranged in a ring-like manner clean the floor surface. An attachment device for a suction wiper includes a wiping plate as a cleaning member. In particular, the cleaning member, which is preferably polygonal or rectangular, is then preferably moved orbitally, i.e. in a circular manner, over a floor surface for cleaning the floor surface. A wiping member is, for example, a cloth or a sponge. A cloth may be a piece of fabric.

In particular, a base apparatus comprises a blower for sucking in air that is sucked in from the floor surface via the attachment device and directed to the base apparatus that is or can be connected to the attachment device. In particular, the base apparatus comprises a filter chamber. The blower conveys the sucked-in dirt from the floor surface through a suction line to the filter chamber. In the filter chamber, the dirt is separated and collected, in particular by means of a filter or a dust filter bag. Preferably, the filter chamber can be loosened to remove the collected dirt or to change a dust filter bag.

If the apparatus is a suction robot, the suction robot comprises the suction opening, the electric motor, and the cleaning roller as described above in the context of the attachment device. In addition, the robot vacuum also comprises a blower, a suction line, and/or a filter chamber.

The electric motor drives the cleaning member, preferably via a thread. In particular, the electric motor drives a cleaning roller to rotate around a roller axis that is oriented parallel to the underside of the apparatus and/or parallel to the floor surface. Preferably, the electric motor for the cleaning member does not drive a blower. In particular, a blower is driven by a separate blower motor. A rotation axis of a cleaning member, in particular a roller axis of a cleaning roller, runs transverse to a feed direction in which the apparatus is moved or moves autonomously.

A cleaning roller is in particular a bristle roller with a plurality of brushes projecting radially from the cylindrical roller. The brushes or bristles can transport dirt, i.e. fine dust, dust and/or coarse material, and/or loosen it from the ground in an improved manner. The cleaning roller is in particular designed as a hollow cylindrical body and/or is preferably arranged within a suction space. A suction space can be formed by means of sealing lips between the underside and the floor surface, wherein the suction opening is arranged within the suction space in order to suck air out of this suction space so that a low pressure prevails within the suction space compared to the ambient pressure. The sealing lips extend from the underside of the attachment device to the floor surface.

For example, a hard floor surface corresponds to the surface condition of tile flooring, laminate flooring or parquet flooring, in particular according to IEC 62885-2:2016. For example, a carpet floor surface corresponds to the surface condition of Wilton carpet, in particular BIC3 according to standard IEC 62885 (e.g. based on a rating of 1 to 5) or according to IEC 62885-2:2016, Annex C.1-Wilton Carpet.

In particular, the electric motor is a DC motor. Due to attractive and repulsive forces exerted on each other by several magnetic fields (Lorentz force), a rotor rotates relative to a stator. The rotor moves a shaft which transmits a torque, in particular via a transmission (gearbox), to the cleaning roller. The stator may comprise a permanent magnet or electric coils with windings. The rotor may comprise electric coils with windings or a permanent magnet. By varying the current flow through the coils as the rotor rotates relative to the stator, continuous rotation is achieved. A stator is a fixed, magnetically acting part of an electric motor. In particular, the stator is fixed to a motor housing. A rotor is a rotating, magnetically acting part of an electric motor that rotates a shaft.

Preferably, the electric motor is a brush motor or DC motor with brush, also called BDC motor. In particular, the stator then surrounds an internal rotor. Alternatively, the stator is internal and the rotor rotates around the stator. The rotor comprises an armature and coils. The armature is preferably an iron core of the rotor around which the coils of the rotor are wound to form at least pole pieces. A pole piece is a bulge in the iron core designed to focus the magnetic field to that location. A commutator is provided in a brushed electric motor to reverse the direction of current in the coils as a function of the rotational position. A commutator is in particular a disc with electrical connections in the form of ring segment-like sections of the disc, each of which is electrically connected to a coil. A brush is used to electrically connect an electrical circuit to the terminals on the rotating disc. When the disc rotates together with the rotor, the circumferentially separated ring-segment-like sections or terminals of the coils are used to reverse the polarity of a coil depending on the rotational position of the rotor with respect to the stator.

Alternatively, the electric motor may be a brushless DC motor. An iron core wound with winding wire forms a coil. The iron core is preferably produced from stacked sheets, which are preferably electrically insulated from each other. In particular, the stator comprises the iron core. Alternatively or complementarily, the rotor comprises the iron core with wound coil. Preferably, the electric motor is designed as an internal rotor motor. Alternatively, it is also possible that the electric motor is designed as an external rotor motor. In one embodiment, the electric motor is a reluctance motor, in particular with a fixed coil as the stator and a rotating iron as the rotor, which preferably has a gear-like shape with radially extending projections to form pole teeth.

The invention claimed is:

1. An apparatus for cleaning a floor surface comprising:

a control unit, a cleaning member for picking up dirt from the floor surface by moving the cleaning member, and an electric motor for moving the cleaning member, wherein the electric motor is such that a relative movement between a stator and a rotor of the electric motor causes an induction of a voltage and a reverse current, wherein the control unit is configured such that a power supply of the electric motor is temporarily interrupted during a cleaning operation of the floor surface, and wherein the control unit is configured to identify a present surface condition of the floor surface currently being cleaned using the cleaning member based on a detected current curve of the electric motor.

2. The apparatus of claim 1, wherein the control unit is configured to identify the present surface condition in response to the current curve reaching or falling below a predefined reduced value.

3. The apparatus of claim 2, wherein the predefined reduced value is zero amperes or lower than 0.5 A.

4. The apparatus of claim 2, wherein the control unit is configured to determine the surface condition of the floor surface, based on a time period (Δt) from the interruption of the power supply until the current curve reaches or falls below the predefined reduced value.

5. The apparatus of claim 1, wherein the control unit is configured to identify the present surface condition, based on whether the determined time period (Δt) falls below a threshold value, exceeds a threshold value or falls into one of several predefined value ranges, to each of which a predefined surface condition is assigned.

6. The apparatus of claim 1, wherein at least one of a hard floor surface and a carpet floor surface is the predefined surface condition stored in the control unit.

7. The apparatus of claim 1, wherein the control unit is configured to identify a degree of contamination of the floor surface and/or a degree of wear of the cleaning member based on the detected current curve.

8. The apparatus of claim 1, wherein the cleaning member is a cleaning roller, and wherein the control unit includes at least two cleaning modes, each of which specifies a different target speed for the cleaning roller.

9. The apparatus of claim 8, wherein the cleaning modes include at least one of a carpet cleaning mode and a hard floor cleaning mode, and wherein a target rotational speed of the cleaning roller in the carpet cleaning mode is greater than the target rotational speed of the cleaning roller in the hard floor cleaning mode.

10. The apparatus of claim 1, wherein the control unit is configured to, in response to identifying a change in the present surface condition, switch between the cleaning modes.

11. The apparatus of claim 1, wherein the control unit is configured to change the cleaning mode in response to a new surface condition being identified in an unchanged manner for a predefined period of time.

12. The apparatus of claim 11, wherein the predefined period of time is at least 200 ms and/or at most 800 ms.

13. The apparatus of claim 1, wherein the control unit is configured such that the power supply to the electric motor is interrupted at a regular interval and the present surface condition of the floor surface is identified on the basis of the detected current curve.

14. The apparatus of claim 13, wherein the interval is at least 100 μs and/or at most 200 μs.

* * * * *